US008474172B2

(12) United States Patent
Ivtsenkov et al.

(10) Patent No.: US 8,474,172 B2
(45) Date of Patent: Jul. 2, 2013

(54) ALERT RF SYSTEM FOR HUNTER PROTECTION

(75) Inventors: Gennadii Ivtsenkov, Hamilton (CA); Alexandre Mantsvetov, Burlington (CA); Evgeny Berik, Tartu (EE)

(73) Assignee: Protective Arms Systems Inc., Burlington, Ontario (CA)

( * ) Notice: Subject to any disclaimer, the term of this patent is extended or adjusted under 35 U.S.C. 154(b) by 18 days.

(21) Appl. No.: 13/031,703

(22) Filed: Feb. 22, 2011

(65) Prior Publication Data

US 2012/0073178 A1 Mar. 29, 2012

Related U.S. Application Data

(60) Provisional application No. 61/386,027, filed on Sep. 24, 2010.

(51) Int. Cl.
*G08B 23/00* (2006.01)

(52) U.S. Cl.
USPC ..... 42/106; 340/505

(58) Field of Classification Search
USPC ..... 42/70.06; 342/45; 340/505
See application file for complete search history.

(56) References Cited

U.S. PATENT DOCUMENTS

| | | | | |
|---|---|---|---|---|
| 5,307,053 | A * | 4/1994 | Wills et al. | 340/573.1 |
| 6,986,302 | B2 * | 1/2006 | LaFata | 89/1.11 |
| 8,179,247 | B2 * | 5/2012 | Ivtsenkov et al. | 340/505 |

* cited by examiner

*Primary Examiner* — Michael Carone
*Assistant Examiner* — Reginald Tillman, Jr.

(57) ABSTRACT

The RF system for preventing hunting accidents comprising RF interrogator mounted on the firearm and RF transponder attached to hunter's coat, wherein dual-diagram microwave channel of the interrogator, which is directed along the sight-line of hunter's rifle, provides alert information about "friendly targets" that could be under fire, such as other hunters or persons and animals equipped with said transponder; and if they are, the system develops alert signal: "Do not shoot".

2 Claims, 9 Drawing Sheets

FEKO 2010-01-05 17:05

FEKO 2010-01-05 17:04

ALERT RF SYSTEM FOR HUNTER PROTECTION

CROSS-REFERENCE TO RELATED APPLICATIONS

This application is the non-provisional application of U.S. Provisional Application No. 61/386,027. It is also related to U.S. patent application Ser. No. 11/685,682, U.S. patent application Ser. No. 12/557,574, U.S. Provisional Application No. 61/114,201, and Canadian Patent No 2,549,727.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATED-BY-REFERENCE OF MATERIAL SUBMITTED ON A COMPACT DISK

Not Applicable.

FIELD OF THE INVENTION

This invention relates generally to systems protecting a person from friendly fire, such as radio (RF) based combat identification (IFF) systems for ground targets and more particularly to systems preventing hunting accidents, which use RF signals emitted by an interrogator and received by transponder of a target (another hunter), which sends RF response alert signal to prevent an accidental fire.

DESCRIPTION OF THE RELATED ART

The present invention is related to U.S. patent application Ser. No. 11/685,682, U.S. patent application Ser. No. 12/557,574, U.S. Provisional Application No. 61/114,201 and Canadian Patent No 2,549,727 filed by the authors of the present invention and dedicated to its civil application, particularly to hunter protection.

The problem of protection a hunter of accidental fire still unsolved. Each year, an alarming number of wild game hunters are accidentally shot by other hunters due to mistaken identity, poor visibility, or mere carelessness. Despite of some measures implemented by Hunter Associations, such as bright orange color of hunter's coat and hat, tragic accidents still continuously occur, especially in the case when the sightline is obstructed and hunter start firing on sound, which, he believes, belongs to animal.

From another hand, it is the solution based on experience with military friend-or-foe (IFF) identification systems. Particularly, the Dismounted Armed Forces have an interest in the remote identification of a person as friend or foe, particularly to prevent friendly fire in armed conflicts. Combat identification devices that are known as friend or foe (IFF) systems are well-known for decades for military aircraft. Such systems are based on RF transmission and very useful for preventing action against friendly aircrafts.

The military platform commanders target friend-or-foe identification presents a difficult decision for a military platform commander, who must decide whether to engage a detected target while avoiding accidental fratricide.

This problem is even more difficult for the dismounted soldier who may be moving covertly through an unknown combat zone at night in the conditions of limited visibility.

The combined optical-radio IFF system dedicated to dismounted soldier was introduced in U.S. patent application Ser. No. 11/685,682 filed by the authors of the present invention. It comprises two channels—optical infrared and Ka-band RF ones, wherein the sharp-diagram optical channel works in the condition of direct visibility, and RF channel having larger diagram (about 17 arc degrees at 8-mm wavelength) gives to shooter information about possible friendly targets in the shooting area directed along the sightline.

For the system exclusively dedicated to prevent hunting accidents, mentioned IFF system can be utilized, but in simplified version containing sharp-diagram RF channel only. Unlike optical signal, RF one passes through the objects, which are not transparent for optical signals, but RF interrogator has relatively wide angular diagram determined by RF signal wavelength, antenna design and aperture.

There are some attempts to utilize RF and optical signal in hunter protecting systems. Two similar systems that, according to the author, can prevent hunting accidents, are described in U.S. Pat. No. 3,400,393 and US Patent Application No 20070205890. Here the authors propose RF system containing continuously-emitting RF beacon attached to a potential target and a sharp-diagram RF receiver mounted on hunter's rifle. The device—the object of these patents—is described in both patents in general form without any details and specifications, such as operational RF wavelength, antenna and unit design and characteristics, etc. The system of U.S. Pat. No. 3,400,393 containing parabolic reflector is bulky and not suitable for hunting. Also, continuously-emitting RF transmitter (beacon) proposed in this patent and patent application continuously consumes energy of battery that is not suitable for miniature device. Another idea generally proposed in the mentioned patent and patent application is a reflector, RF or optical one, attached to a possible target. In this case, hunter's riffle is equipped with full transmitting/receiving unit working as a radio locator. Even though no details or specifications are given by the author about possible design of this system, simple analysis shows that such system can not properly works because of multiple reflections from objects in hunting area, which can not be separate from a "friendly target".

Other attempts to utilize RF transponders to protect hunters are proposes in U.S. Pat. No. 4,833,452 and U.S. Pat. No. 5,307,053. These systems contain transponders which antennas has omnidirectional diagram. According to the patent, each hunter is equipped with such transponder, wherein each transponder sends RF signals to others that is in the area. Therefore, each hunter has information that a number of hunters is in this area. It gives them alert signal: "Be careful".

The systems proposed in the mentioned patents provide just general information about existence of hunters equipped with the transponder in surrounding area, but it does not specify position of each hunter, so such alert can confuse the hunter.

Another system proposed in U.S. Pat. No. 5,183,951 also comprises RF transceivers mounted on a rifle of each hunter who participates in the hunting. According to the author, these transceivers exchange signals so inform a hunter about presence of other hunters in the area. Despite of very general description of this device where the author mostly pays attention to device attachment on a rifle and does not provide any technical specification, it is obvious that such device is omnidirectional one and can not provide information about position of each hunter, therefore this device is useless to really protect hunters from accidental shooting.

RF channel of IFF system described in U.S. patent application Ser. No. 12/557,574 comprises a rifle-mounted interrogator utilizing short-wavelength signal having narrow-diagram RF ray directed along the sightline.

It is known that the sharpness of the directional pattern of transmitter's RF antenna is limited by antenna's aperture; and the antenna's aperture is limited by size and mass requirements for the application. Particularly, for a rifle-mounted device, the antenna's aperture has not to exceed 40×40 mm. Therefore, as calculations reveal, RF antenna with 30-mm aperture has relatively sharp (for RF radiation) transmitting/receiving diagram of about 17 arc degrees at 8-mm RF wavelength. Such diagram allows recognizing a hunter situated in 30-meter area of shooting at the distance of 100 meter. Thus, the system provides information (and alert signal) about presence of "friendly targets" in this area.

The system described in U.S. patent application Ser. No. 12/557,574 requires specially-designed RF units that are unique and dedicated exclusively to hunters. Also, there are a number of conventional devices, such as cell phones, GPS, walk-and-talk transponder, etc. These devices have its own transmitter and receiver operating in L band (0.9-2.4 GHz); many of them (for example, cell phones) are equipped with sophisticated logical unit having own processor and can be re-programmed. Moreover, they are equipped with wireless ports (such as Bluetooth ones) that allow remotely communicate with a number of peripheral devices. Therefore, it is possible to utilize its features in the system for prevention of hunting accidents so simplifying the system. So, it can be little modification of existed devices that includes installation of additional module and re-programming.

Computer simulations of available antenna designs suitable for the interrogator application, which has been performed by the authors of the present invention, reveal that the sharpest possible directional pattern of such antennas can not be less than 10 arc degrees that corresponds to 17-meter area at 100-meter distance. So, in such area can be an animal and a couple of hunters simultaneously, but, obviously, that it is better to miss an animal than shoot a human.

Another approach to precisely detect angular position of "friendly target" equipped with a transmitter is used for decades in military Radar Warning Receivers (RWR). Particularly, this solution was utilized in AN/ALR-67 countermeasures warning and control system that is the standard threat warning system for tactical aircraft.

Angular direction measurement is accomplished here by using a set of four identical matched receivers each fed by an antenna which covers a quadrant of space about the carrying aircraft. By comparing the strength of the output signals from the receivers, the angular direction of the radar can be estimated with reasonable accuracy.

In the case of IFF or hunter-protection system, unlike radar warning system, a radio transmitter can cooperate with a receiver that allows establishing communication between them. Therefore, it is possible to use a single receiver (attached to a rifle) having a number of receiving antennas (like RWR system) and a transmitter attached to a possible target, or a single receiver attached to the target and a transmitter attached to the rifle having a number of sequentially-switched transmitting antennas. In both cases, the signal processing is performed by receiver's electronics, wherein in the second case both, the transmitter (that works as an interrogator) and the receiver (that works as a transponder), have to have additional channel to communicate with each other. The rifle-mounted interrogator having multiple receiving antennas processes the signal coming from transponder's transmitter, or the target-mounted transponder processes the signal coming from a number of transmitting antennas of the interrogator and sends the information to the interrogator. If the target is situated in dangerous sector for example, less than ±5 arc degrees about sightline) directed along rifle's sightline, the alert sign is activated.

SUMMARY OF THE INVENTION

The present invention is dedicated and customized as a system preventing hunting accidents. It is based on the art described in the U.S. Provisional Application No. 61/386,027, and, also, on U.S. Provisional Application No. 61/114,201, U.S. patent application Ser. No. 11/685,682, U.S. patent application Ser. No. 12/557,574, and Canadian Patent No 2,549,727 filed by the authors of the present invention.

The system can save lives especially in the situation when the sightline is shaded by foliage, trees, etc; and when hunter starts shooting in the direction of noise produced by hunted animal or in the direction of unidentified object.

The working distance of the system is up to 100 meters, which can be optionally enlarged to a few of hundred meters. The system provides two-way RF interrogator-transponder communication, wherein said interrogator operating with a single or dual RF beams is mounted on hunter's rifle and said transponder having single antenna is attached to hunter's coat or hat. To prevent possible shadowing of the request signal by hunter's body (when he turn his back to the shooter), it can be two similar transponders attached to front and back of hunter's coat or hat (see FIG. 2).

Another embodiment of the interrogator of the present invention comprises a rifle-mounted dual-beam antenna that allows significantly increasing resolution of the system (see FIG. 7).

THE DRAWINGS

Figure 7:
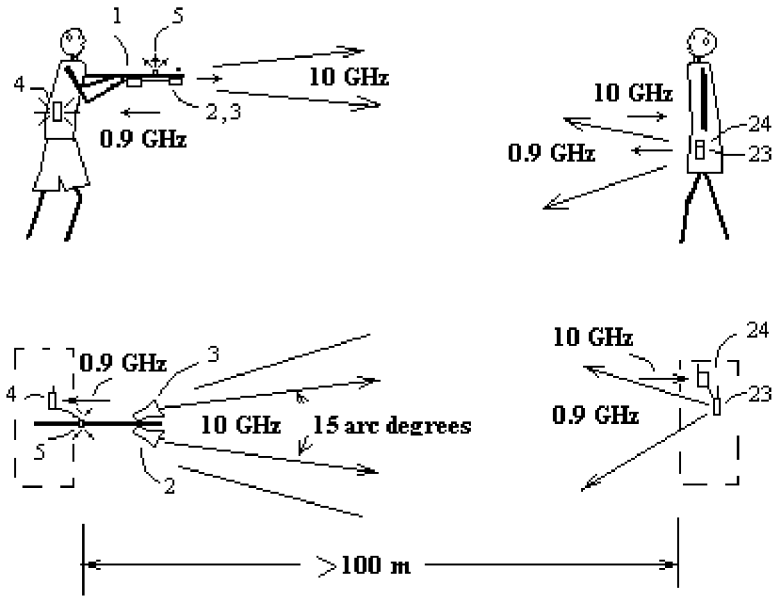
Figure 8:
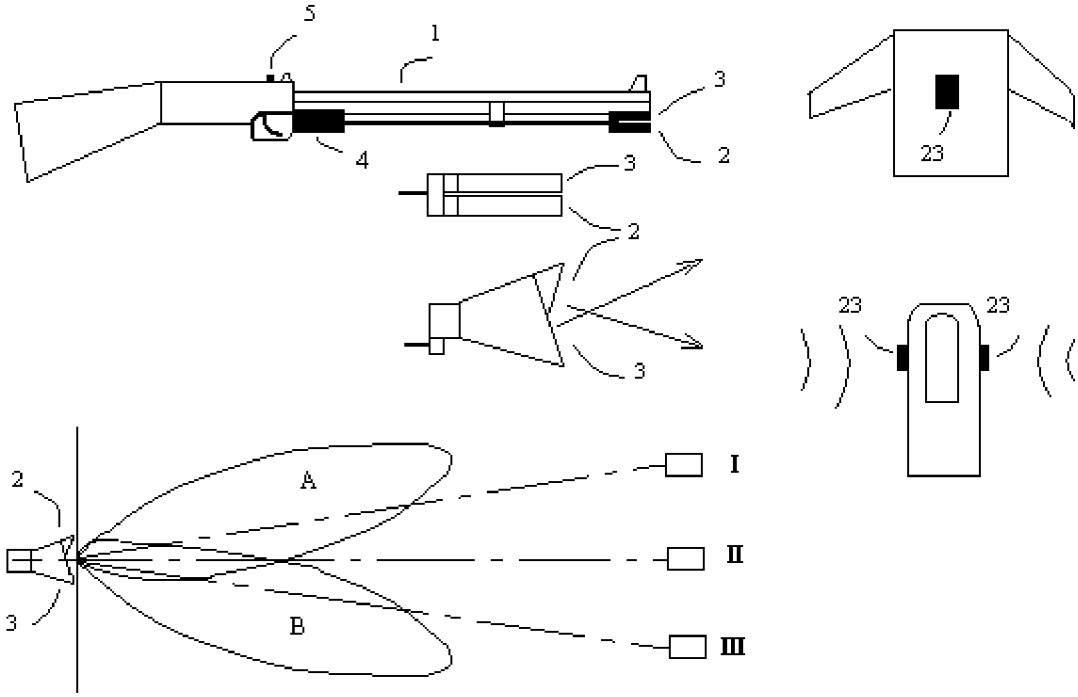
Figure 9:
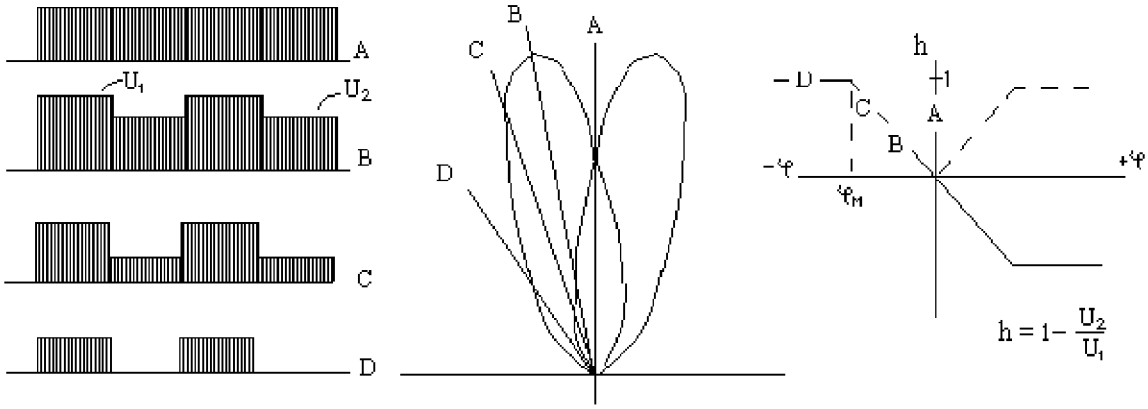
Figure 10:
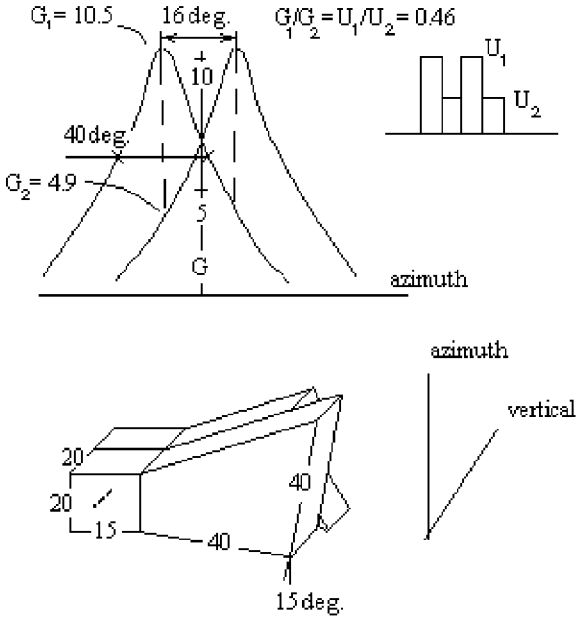
Figure 11:
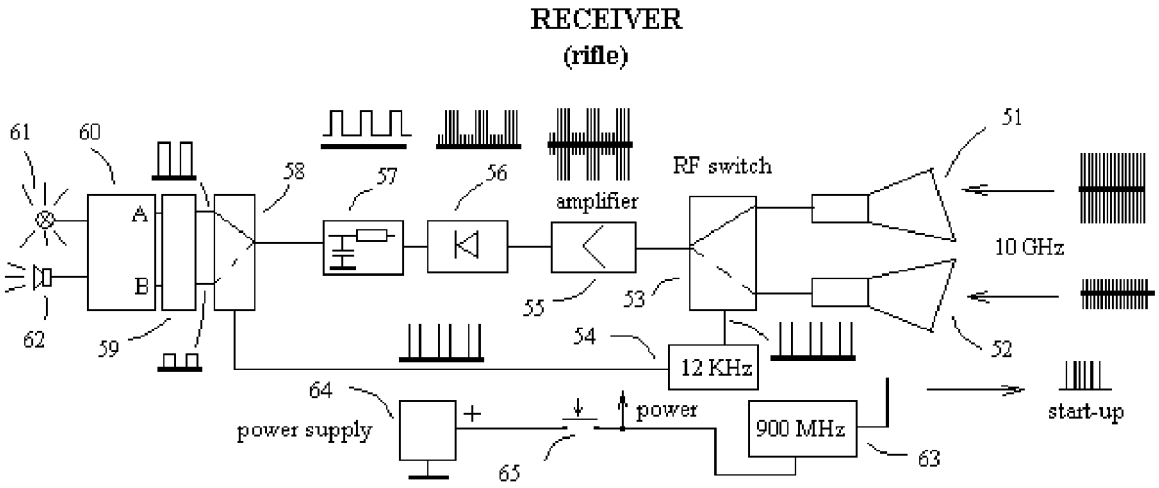
Figure 12:
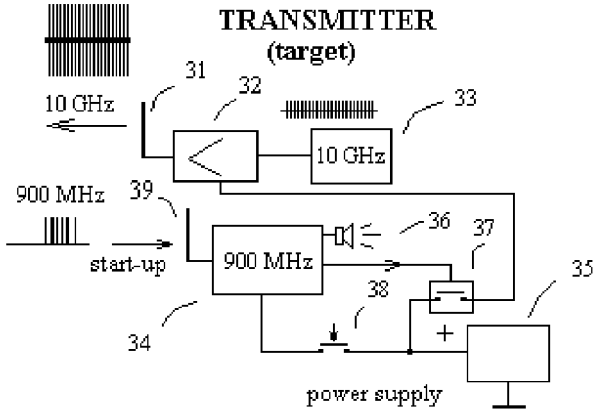
Figure 13:
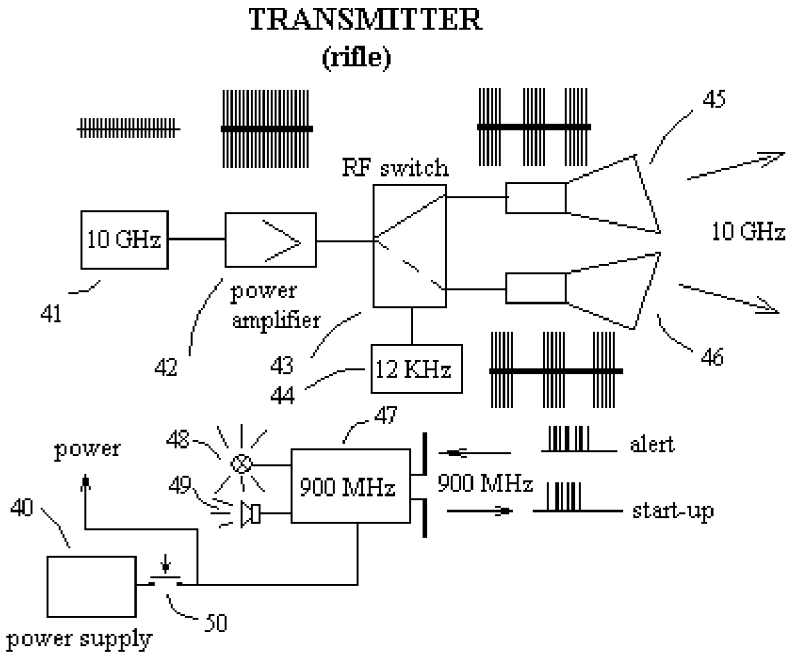
Figure 14:
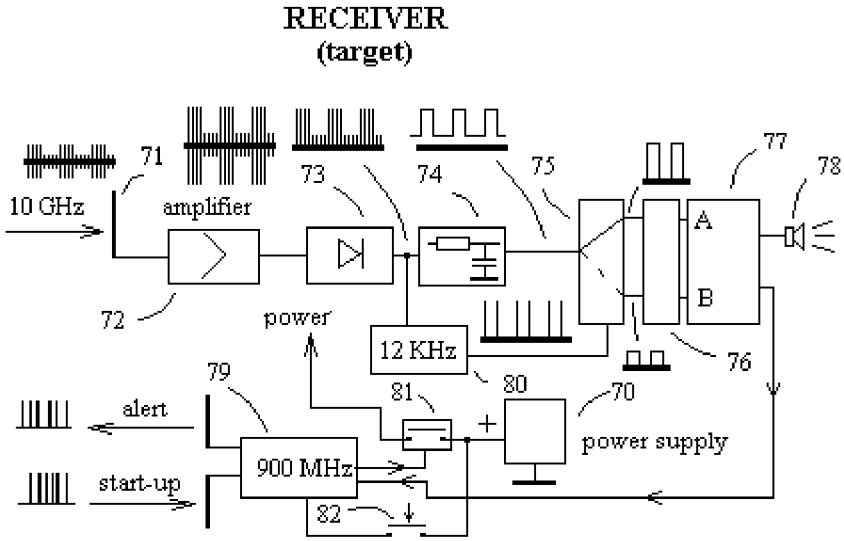
Figure 15:
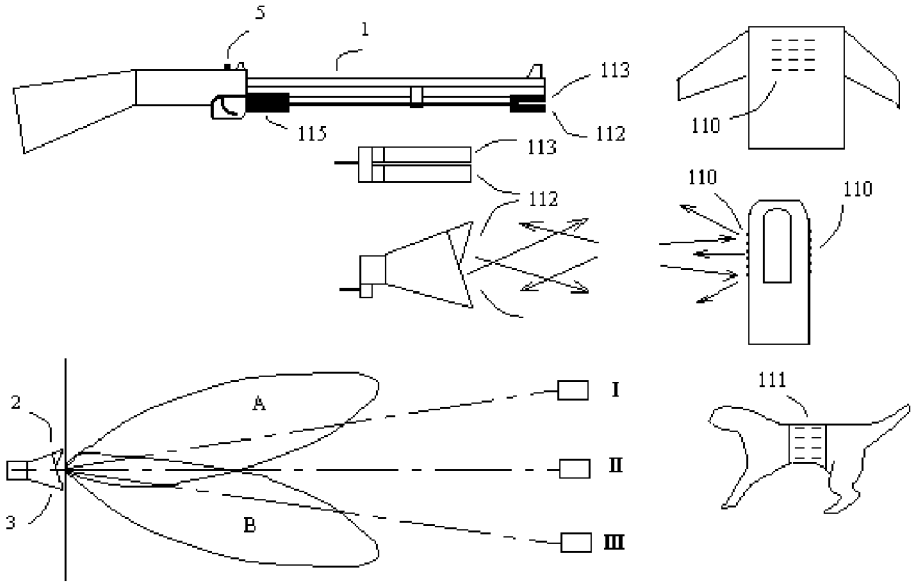
Figure 16:
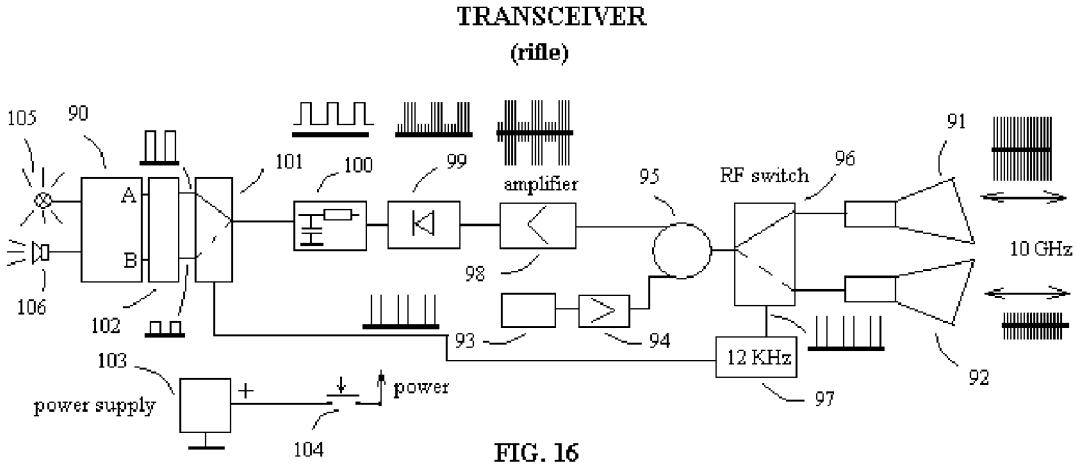

FIG. 7 schematically illustrates principle of operation of the dual-beam system of the present invention, FIG. 8 depicts of possible design of dual-beam interrogator antennas and position of units on the rifle and hunter coat, FIG. 9 depicts the scheme of signal processing for the system equipped with two shifted horn antennas, FIG. 10 depicts the scheme and diagrams of dual-beam horn antennas, FIG. 11 depicts the schematic diagram of the transponder's transmitter of the preferred embodiment, FIG. 12 depicts the schematic diagram of the interrogator's receiver of the preferred embodiment, FIG. 13 depicts the schematic diagram of the interrogator's transmitter of another embodiment, FIG. 14 depicts the schematic diagram of the transponder's receiver of another embodiment, FIG. 15 schematically illustrates principle of operation of the dual-beam system of another embodiment utilizing reflectors attached to the target, FIG. 16 depicts the schematic diagram of the rifle-mounted transceiver of another embodiment.

DETAILED DESCRIPTION OF THE PREFERRED EMBODIMENT OF THE INVENTION

RF System for Preventing Hunting Accidents

Figure 1:
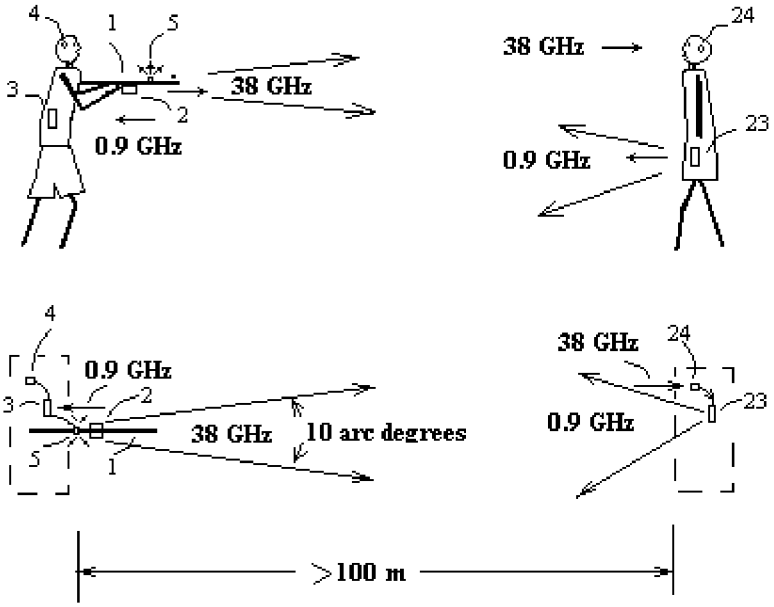
FIG. 1 illustrates operation of the system of the present invention.

The schematic diagram of the prevention system of the present invention and its operation is depicted in FIG. 1.

The system for prevention of hunting accidents—the object of the present invention—generally includes a RF interrogatory (request) unit 2 and a RF transponder (response) unit 3 sending RF response signal when it is activated by the request signal of the interrogator, wherein the interrogator is mounted on hunter's rifle 1 and the transponder 3 attached to hunter's coat 4 in any convenient place.

The interrogator contains transmitting (request) RF channel operating in short-wavelength Ka band (such as 38 GHz and up) and having sharp diagram provided by transmitting antenna of interrogator 2, which is essential for the system operation. The response channel of the transponder, which, unlike the request channel does not require sharp-diagram RF ray, utilizes conventional cell phone waveband, such of 0.9 GHz, wherein conventional cell phones 3 and 23 with little modification are used as transponders. Therefore, the rifle-mounted interrogator 2 only contains the RF transmitter 214 and Bluetooth unit 212 (see FIG. 2) that communicate with cell phone 3, whereas all other functions are performed by said cell phones 3 and 23. To achieve two-way communication between a shooter and possible target, each of said cell phones is equipped with tiny downconverter units 4 and 24. So, the unit 24 of possible target receives high-frequency RF request signals (38 GHz) sent by the interrogator 2 and convert it into conventional wavelength used by Bluetooth devices (such as 2.4 GHz). The units 24 communicates with cell-phone 23, which send omnidirectional RF signal (0.9 GHz or other frequency of cell phone bands) to cell phone 3 that communicates with Bluetooth unit of the interrogator 2, which sends command to Bluetooth unit (position 212 on FIG. 2) to activating light 15 mounted on sight of the rifle 1 and buzzer 216. To minimize time delay, the cell phones 3 and 23 are re-programmed to get the option of direct communication like walk-and-talk devices.

The request signal sent by rifle-mounted interrogator 2 is modulated by Bluetooth communication protocol; therefore, after downconverting, the cell phone 23 recognizes the request signal as a Bluetooth message, so it follows the command written in this message. To avoid interference from reflected signal, the interrogator 2 is communicates with cell phone 3 (that belongs to the shooter) via Bluetooth unit (position 212 on FIG. 2) to set time delay (about 1 millisecond) in which the cell phone 3 rejects incoming signals.

Therefore, all hunters and any person (also, it can be hunter's dog), who is in hunting area, are equipped with such cell phones 3 and 23 having wireless Bluetooth units 4 and 24; and only hunters have said interrogators 2 that are mounted on their rifles 1. To avoid unwanted RF signal absorption caused by human body (when the possible target turns back to shooter), the Bluetooth units 4 and 24 should be attached to both sides of hunter's coat or hat.

In this embodiment, the cell phone requires only re-programming; and downconverters 4 and 24 are only additional devices that transform such combination into IFF-like system. Because the rifle-mounted interrogator of the present invention contains only transmitter and small Bluetooth unit, the interrogatory unit of the present invention is light, has a small size and inexpensive.

Because modern cell phones has five operational waveband including international ones that are not in use in North America, such as 0.9 GHz, these channels can be recommended for such communication as interference-free ones.

Another variant of the preferred embodiment comprises modified cell phones that contain built-in Ka-band receivers directly receiving RF signal sent by the interrogator. This embodiment requires custom modification of existed cell phones specifically dedicated to hunters.

Figure 2:
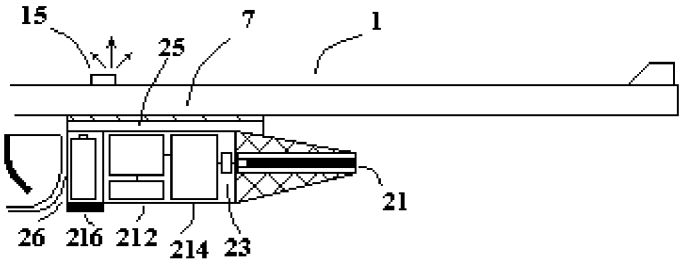
FIG. 2 depicts of possible design of the single-beam interrogator and its position on the rifle.

Proposed design of the interrogator is shown on FIG. 2. The interrogatory unit comprises polyrod antenna array 21, RF transmitter 214, processor 25, Bluetooth unit 212, power source (battery) 26 and buzzer 216. To fasten the interrogator on rifle's barrel, the interrogatory unit is equipped with magnet 27.

Figure 3:
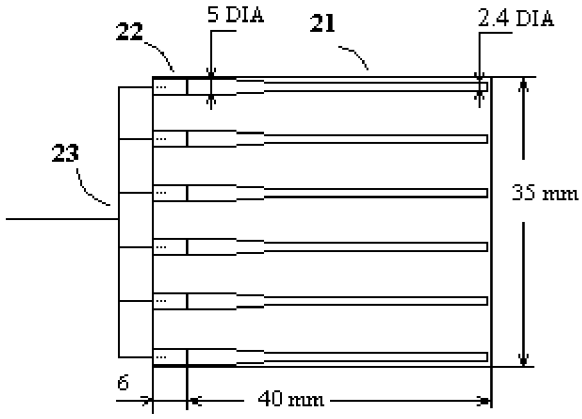
FIG. 3 depicts of possible design of the single-beam interrogator transmitting antenna array.

To achieve the sharpest directional pattern (10 arc degrees at 38 GHz), antenna of the interrogator 2 is made as a polyrod linear array. The scheme of the antenna is depicted in FIG. 3.

Figure 4:
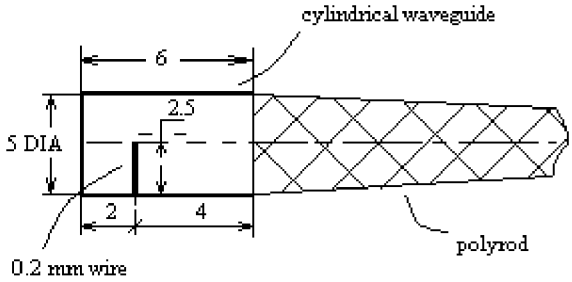
FIG. 4 depicts in detail design of polyrod element of the single-beam transmitting antenna array.

Here, the antenna contains 6 short cylindrical waveguides 22 connected to Teflon rods 21 (or made of dielectric material having dielectric constant from 2 to 3), wherein the waveguides are spaced at ¾λ (6 mm at 38 GHz). The waveguides are excited by 2.5-mm wires (see FIG. 4), wherein the signal feed the wires via micro-strip splitter 23.

Figure 5:
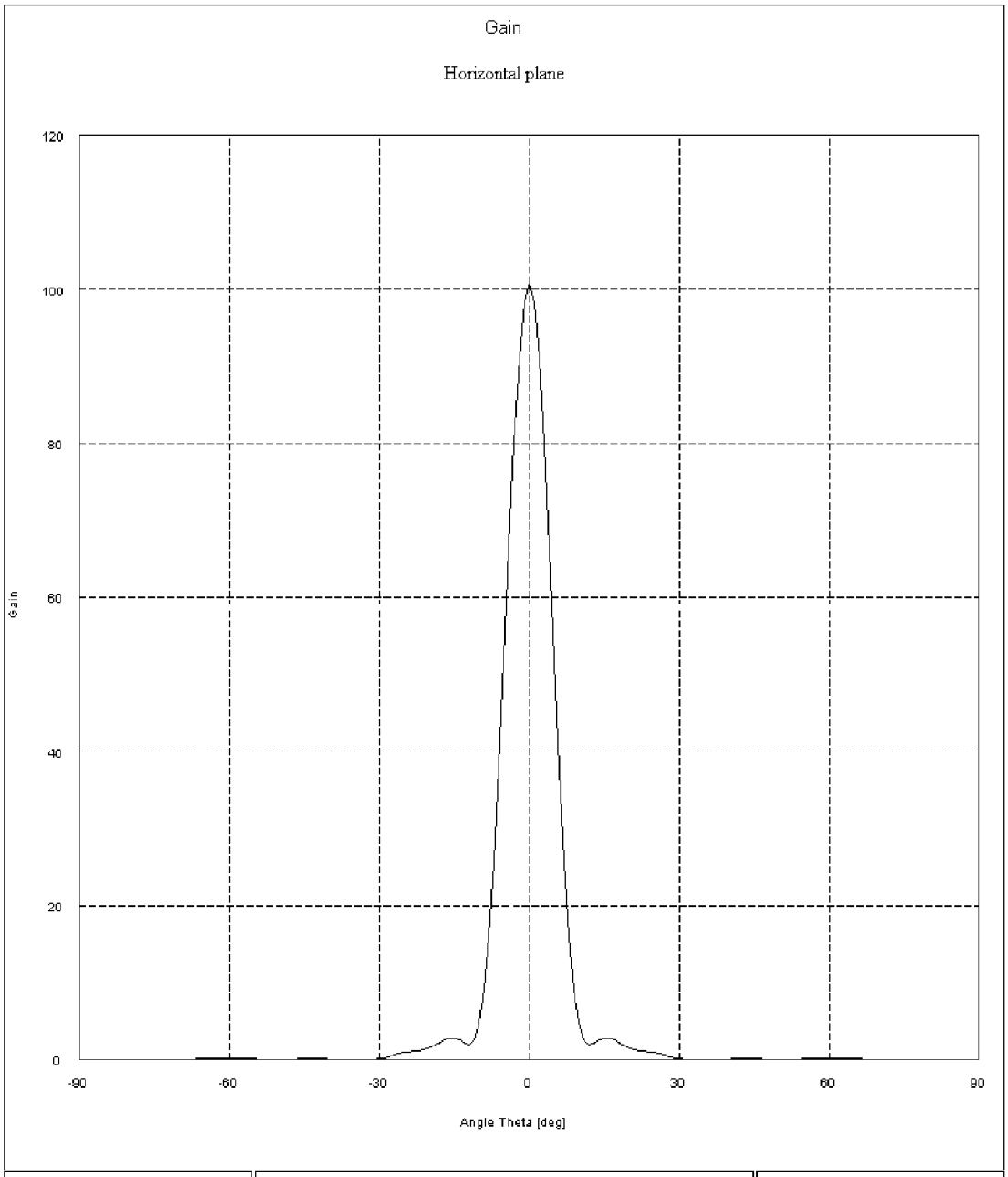
FIG. 5 depicts graph of gain of the antenna array in horizontal plane.
Figure 6:
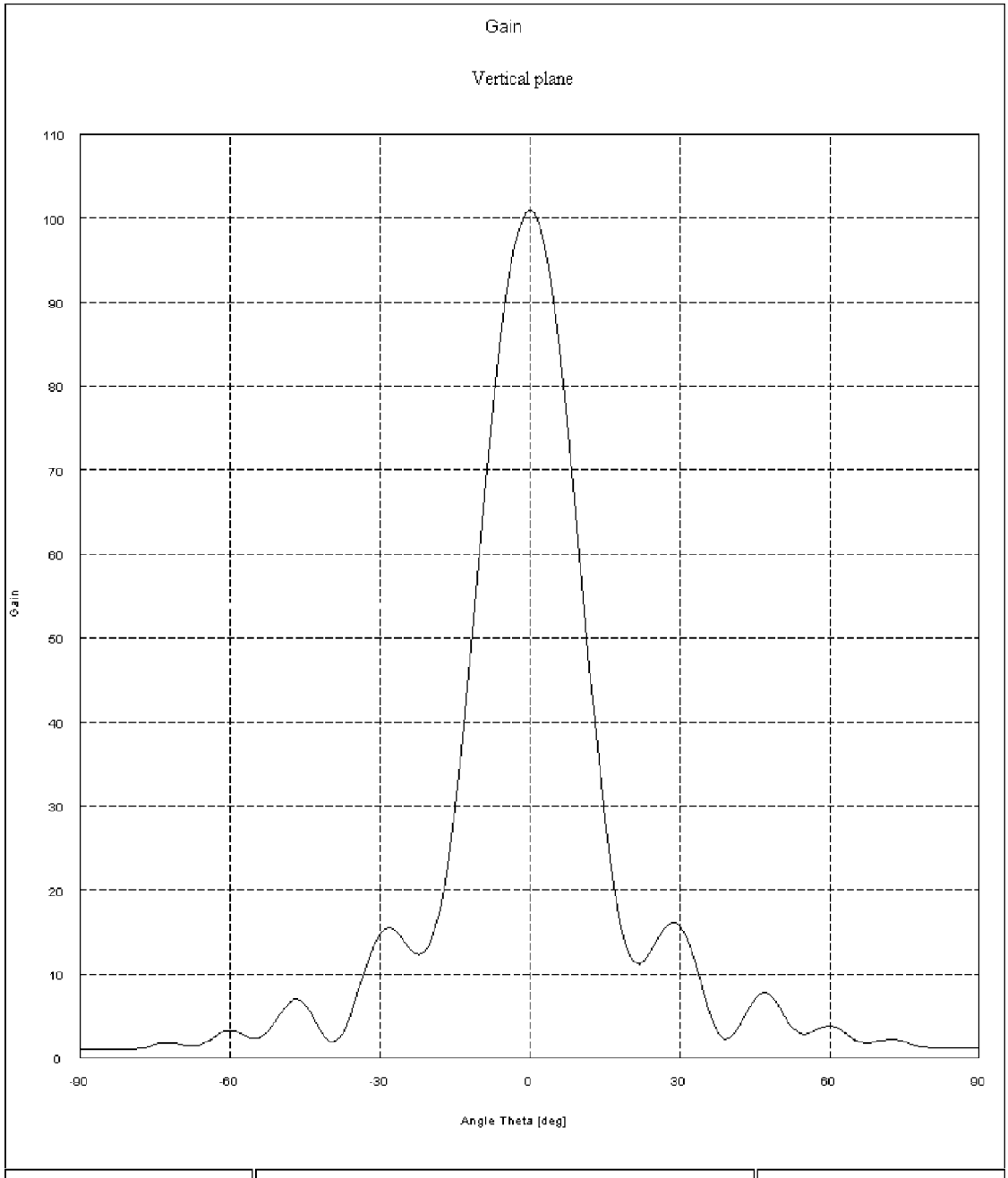
FIG. 6 depicts graph of gain of the antenna array in vertical plane.

The graph of antenna gain at 0-angle (horizontal plane) and 90-degree angle (vertical plane) are shown on FIG. 5 and FIG. 6, wherein the horizontal plain resolution (about 10 arc degrees at ½-power level) is essential for this application.

Also, the antenna can be of any design that provide sharp directional pattern, such as a horn one or a combination of linear array with dielectric lens.

Detailed Description of Another Embodiment of the Invention

System for Preventing Hunting Accidents Comprising a Dual-Beam RF Rifle-Mounted Receiver Principle of operation of the dual-beam system is depicted in FIG. 7. That is similar to one of the preferred embodiment of the present invention, except operation of the interrogator that has dual-beam antennas sequentially received RF signal coming from the friendly target, wherein communication between the interrogator and transponder is performed by means of another low-frequency RF channel. As an example, FIG. 7 depicts the system utilizing 10 GHz RF waveband for an interrogatory signal, and 900-MHz for communication between said interrogator and transponder.

The schematic diagram of elements of the prevention system of this embodiment is depicted in FIG. 8.

This embodiment of the system for prevention of hunting accidents operates with dual-beam interrogator. It includes a rifle-mounted RF interrogatory unit 4 equipped with two antennas 2 and 3 and a RF transponder unit 23 (one or two) is attached to hunter's coat (or hat), wherein the interrogatory unit 4 is mounted on a barrel 1 of the rifle in any convenient place, whereas the antennas 2 and 3 are attached to the barrel close to barrel's end.

The interrogatory unit 4 contains receiving RF channel operating in short-wavelength band and having sharp diagram antennas 2 and 3, wherein its directional patterns (A and B on FIG. 2) are azimuthally shifted in opposite directions at some angle about sightline of the rifle. The transmitting channel of the transponder 23, which equipped with wide-diagram RF antenna, emits non-modulated RF signal. The system operates in microwave waveband, such as Ku or Ka band providing relatively narrow directional pattern for interrogator's receiver. As an example, the present invention describes the system operating at 10 GHz RF, but it can operate at shorter wavelength.

The principle of operation is depicted in FIG. 9. Here, the interrogator transmits non-modulated plain signal; and the interrogator's receiver sequentially switches receiving antennas (positions 2 and 3 on FIG. 9). Therefore, the signal received by the interrogator becomes amplitude-modulated in accordance with the switching frequency of the antennas as depicted in FIG. 3. If the transmitter is situated on the sightline (position A on FIG. 9), modulation of the signal disappears. When line interrogator-transponder is azimuthally shifted on angle $\phi$ about the sightline, (positions B, C, D on FIG. 3), the signal starts being rectangular-pulse modulated; and modulation depth ($h=1-U_2/U_1$) depends on said shift $\phi$ as shown on the graph depicted in FIG. 9. If said angular shift exceeds some angle $\phi_m$, h=1 and does not change with $\phi$ increasing. The graph $h=f(\phi)$ on FIG. 9 appears to be similar to target bearing graphs of homing heads, so it can be processed in the same way. The estimation of direction finding accuracy of the system having such dual antenna—two sequentially-switched horn antennas operating at 10 GHz is illustrated on FIG. 10. Here, two horn antennas, a first and a second one, have rectangular flares with 40×20-mm aperture, wherein said antennas are placed closely one above another. Flare output of the first antenna is cut on +15 arc degrees, whereas flare output of the second antenna is cut on −15 arc degrees, so angle between output planes of said antennas and the sightline is ±15 arc degrees in azimuth plane. As computer simulation reveals, directional patterns of these antennas become shifted azimuthally about the sightline on ±8 arc degrees (see FIG. 10). Width of directional pattern (HPBW) of each antenna is about 40 arc degrees, so when the line antenna-transmitter is shifted on 8 arc degrees about the sightline, modulation depth of the signal is approximately equal to 0.5. If it estimates the lower limit of modulation depth as 0.05, the accuracy of direction finding will be about ±2 arc degrees.

Another variant of the dual antenna comprises two horn antennas placed closely one above another and angularly shifted in horizontal plane (symmetrically about the sightline), so axis of said antennas and their directional patterns are turned azimuthally in opposite directions. In this case, angular shift of directional patters of the first and the second antennas is approximately equal to the angle on which said axis are turned. Accuracy of direction finding of this variant is close to one described above.

Another possible algorithm of signal processing comprises evaluation of ratio of average RF signal received by the receiver and AC signal of modulation of said received signal.

The 10-GHz frequency channel is given here as an example of the embodiment. Frequency of this channel can vary from 5 GHz up to 60 GHz, wherein higher frequency provides higher angular accuracy, but with higher cost of units and less distance of operation. Also, frequency of antenna switching can vary in vide range from a few kilohertz to a few megahertz.

Description of Interrogator of this Embodiment Comprising a Dual-Beam RF Rifle-Mounted Receiver The main element of this rifle-mounted interrogator is the receiver equipped with dual-beam antennas.

The scheme of the interrogator's receiver of this embodiment is depicted in FIG. 11.

The system consists of two channels, wherein one of them operates at microwave K-band, whereas another one operates at frequency of 900 MHz; wherein 900-MHz channel is just a transmitter (position 63 on FIG. 11). It utilizes wide-diagram antenna that is used to send start-up, shut-off and alert signals to all targets equipped with the transponder of this system situated in surrounding area. This start-up signal activates 10-GHz transmitter of said transponder that starts emitting 10 GHz plain signal until it receives said shut-off signal.

This 10-GHz signal is received by antennas 51 and 52 that are connected to 10-GHz amplifier 55 via RF switch 53. The RF switch 53 that is controlled by generator 54 sequentially connects antennas 51 and 52 to input of the amplifier 55. Therefore, if the signals entering antennas 51 and 52 have different amplitudes (see FIGS. 3 and 4), the signal entering amplifier 55 becomes modulated with the switching frequency (for example, 12 KHz). Amplifier 55 amplifies 10-GHz signal that is further detected by detector 56. The detected signal passes filter 57 that removes 10-GHz carrier frequency, therefore the filtered signal is sequences of rectangular-shaped pulses, wherein ratio of amplitudes of said pulses represents depth of signal modulation that is a function of angular shift between the sightline and the rifle-target line. In the case, when the sightline is directed to the target, the signal modulation disappears and output of the filter 57 is DC. To further process the signal, output of the filter 57 is sequentially connected to input A and input B of processor 60 via switch 58 and ADT 59. The switch 58 is controlled by the same generator 54 that controls RF switch 53; therefore the RF signals coming from the antennas 51 and 52 and the detected signals coming from the filter 57 are synchronized. Thus, part of the signal, which is proportional to amplitude of RF signal received by antenna 51, is directed to input A of the processor 60, whereas part of the signal, which is proportional to amplitude of RF signal received by antenna 52, is directed to input B of the processor 60. ADT 59 digitizes the signals; so processor 60 calculates ratio of these signals and finally calculates said angular shift between direction to the target and rifle's sightline. If the target is situated in angular sector of ±5 arc degrees (for example), the processor 60 activates alert sound buzzer 62 and alert LED 61. It, also, sends to the target additional alert signal via 900-MHz transmitter 63. The interrogator is activated manually by power switch 65 that connect all users to power supply 64.

As is shown on FIGS. 9 and 10, angular resolution of the system depends on width of directional pattern of each antenna and angular shift of these patterns about central line (the sightline). For the angular shift of ±15 arc degrees (40-degrees HPBW), the resolution can achieves ±1-±2 arc degrees.

To increase sensitivity of the receiver, the amplifier 55 can be substitute by heterodyne receiver, wherein frequency of 10-GHz signal is downconverted to 1.4-GHz (or less).

Description of Transponder of this Embodiment Comprising a Dual-Beam RF Rifle-Mounted Receiver The scheme of the transponder is depicted in FIG. 12.

The transponder of this embodiment is attached to the target (see FIG. 7, 8). The main element of the transponder is a transmitter that emits plain 10-GHz sinusoidal signal.

The system consists of two channels operating at 10 GHz and 900 MHz, wherein 900-MHz channel is just a receiver. It utilizes wide-diagram antenna used to receive start-up, shut-off and alert signals sent by the 900-GHz transmitter of the interrogator, wherein, being activated by said start-up signal, 10-GHz transmitter of the transponder start transmitting plain 10-GHz sinusoidal signal until it receives said shut-off signal.

The transponder comprises 900-MHz receiver 34 equipped with azimuthally omnidirectional antenna 39, 10-GHz oscillator 33, 10-GHz power amplifier 32, 10-GHz azimuthally omnidirectional antenna 31, power supply 35, automatic and manual switches 37 and 38.

The transponder operates as follows:

900-MHz channel (receiver) is activated manually by means of the switch 38. When it receives the start-up signal from the interrogator, it switches on power of 10-GHz transmitter by means of electro-mechanical switch 37. So said 10-GHz transmitter starts continuously transmitting plain 10-GHz sinusoidal signal until it receives the shut-off signal sent by the interrogator from which said start-up signal comes. If the processor of the interrogator detect that the target is in dangerous sector, it sends additional alert signal. This signal activates alert buzzer 36 informing the target that he (she) could by under fire.

Detailed Description of Another Embodiment of the Invention

System for Preventing Hunting Accidents Comprising a Dual-Beam RF Rifle-Mounted Transmitter In this embodiment a rifle-mounted interrogator contains dual-beam 10-GHz transmitter equipped with two sequentially-switched transmitting antennas, whereas the target has a transponder that is equipped with 10-GHz transmitter having single omnidirectional receiving antenna. The system also equipped with duplex 900-MHz channel that allows exchanging service signals between said interrogator and said transponder. Principle of operation and signal processing procedures are very similar to ones utilized in the preferred embodiment of the present invention described above, but in this embodiment all signal processing is performed by the transponder.

Description of Rifle-Mounted Interrogator of this Embodiment Comprising a Dual-Beam RF Rifle-Mounted Transmitter The scheme of the interrogator of this embodiment is depicted in FIG. 13.

The system contains two channels operating at 10 GHz and 900 MHz, wherein 900-MHz unit 47 includes a transmitter and receiver. This 900-MHz unit 47 utilizes two omnidirectional antennas that are used to send start-up, shut-off signals to all targets equipped with the transponder of this system situated in surrounding area, and to receive alert signals coming from the targets, which are situated in the sector that could be on fire. This start-up signal activates 10-GHz receiver of said transponder that starts receiving 10-GHz signal sent by the interrogator until it receives said shut-off signal.

Here, 10-GHz plain sinusoidal signal is developed by oscillator 41, amplified by 10-GHz power amplifier 42 and transmitted by antennas 45 and 46 which directional patterns are shifted azimuthally on some angle. The antennas 45 and 46 are connected to 10-GHz power amplifier 42 via RF switch 43 that is controlled by generator 44; so the switch 43 sequentially connects antennas 45 and 46 to output of the amplifier 42. Therefore, 10-GHz signal is sequentially sent by antenna 45 and 46. Therefore, even though the signals emitted by antennas 45 and 46 have equal amplitudes, the signal receiving by the transponder becomes modulated with the switching frequency (frequency of the generator 44) if the line rifle—target is shifted about the sightline. The transponder of the possible target processes this signal and, if the target is in danger, sends alert signal to the interrogator via 900-MHz channel.

900-MHz channel of the also comprises sound 49 and light 48 alert signals activated by said 900-MHz alert signal coming from target's transponder.

Description of Transponder of this Embodiment Comprising a Dual-Beam RF Rifle-Mounted Transmitter In this embodiment all signal processing is performed in the transponder.

The scheme of the transponder of this embodiment is depicted in FIG. 14.

The transponder comprises two channels: 10-GHz receiving channel and 900-MHz transmitting/receiving channel providing signal exchange between the transponder and interrogator. This 10-GHz channel comprises omindirectional antenna 71, 10-GHz amplifier 72, detector 73, filter 74, switch 75, ADT 76 and processor 77; and 900-MHz channel comprises 900-MHz transceiver 79 equipped with receiving and transmitting omnidirectional antennas.

Here, 10-GHz signal coming from interrogator antennas (positions 45 and 46 on FIG. 13) is received by omnidirectional antenna 71 of 10-GHz receiver of the interrogator. If the rifle-interrogator line is shifted about rifle's sightline, the 10-GHz signal received by antenna 71 becomes modulated with the frequency of antenna switching (12 kHz on FIG. 13). This signal is amplified by 10-GHz amplifier 72, detected by detector 73 and filtered by filter 74. Thus, the signal coming from the filter 74 is the sequences of rectangular-shaped pulses, wherein ratio of amplitudes of said pulses represents depth of signal modulation that is a function of angular shift between the sightline and the rifle-target line. To further process the signal, output of the filter 74 is sequentially connected to input A and input B of processor 77 via switch 75 and ADT 76. The switch 75 is controlled by logical unit 80 that develops switching pulses from fronts of said sequential rectangular-shaped pulses coming from filter 74. Thus, part of said rectangular-shaped signal, which is proportional to amplitude of RF signal transmitted by antenna (position 45 on FIG. 13), is directed to input A of the processor 77, whereas part of the signal, which is proportional to amplitude of RF signal received by antenna (position 46 on FIG. 13), is directed to input B of the processor 70. ADT 76 digitizes the signals; so processor 77 calculates ratio of these signals and finally calculates said angular shift between direction to the rifle and rifle's sightline. If the target is situated in angular sector of ±5 arc degrees (for example), the processor 77 activates alert sound buzzer 78. It, also, sends to the rifle-mounted interrogator alert signal via 900-MHz transceiver 79. The transponder's 900-MHz transceiver is activated manually by power switch 82, whereas all elements of 10-GHz channel are activated by start-up signal coming from the interrogator. So, said 900-MHz transceiver activates electro-mechanical switch 81 that connect all elements of 10-GHz channel to power supply 70. This 10-GHz channel still activated until said 900-Mhz transceiver receives shut-off signal from the interrogator. 900-Mhz channel of the transponder still activated in waiting mode until it is switched off by switch 82.

As is shown on FIGS. 9 and 10, angular resolution of the system depends on width of directional pattern of each antenna of the interrogator and angular shift of these patterns about central line (the sightline). For the angular shift of ±15 arc degrees (40-degrees HPBW), the resolution can achieves ±1-±2 arc degrees.

To increase sensitivity of the receiver, the amplifier 73 can be substitute by a heterodyne receiver, wherein frequency of 10-GHz signal is downconverted to 1.4-GHz (or less). Variant of this embodiment can include additional signal send by the interrogator, which synchronizes switching said antennas with switching A and B channels.

The 10-GHz frequency channel is given here as an example of the embodiment. Frequency of this channel can vary from 5 GHz up to 60 GHz, wherein higher frequency provides higher angular accuracy, but with higher cost of units and less distance of operation. Also, frequency of antenna switching can vary in vide range from a few kilohertz to a few megahertz.

Detailed Description of Another Embodiment of the Invention

System for Preventing Hunting Accidents Comprising a Dual-Beam RF Rifle-Mounted Transceiver and Attached to Target's Coat RF Reflectors The scheme of operation is depicted in FIG. 15.

This embodiment comprises RF transceiver 115 attached to rifle's barrel 1, which is equipped with two antennas 112 and 113 that are similar to ones of the preferred embodiment and sequentially switched by RF switch (position 96 on FIG. 16). Said transceiver 115 includes RF transmitter and RF receiver operating at the same RF frequency, wherein transmitting and received signals are separated by RF circulator (position 95 on FIG. 10). The target of this embodiment is equipped with passive dipole reflectors 110 attached to hunter's coat or to piece of cloth. Such passive reflecting elements 111 can be attached to any target including hunter's dog as depicted in FIG. 15.

The system operates as follows:

The shooter activates the transceiver 115 that sequentially sends plain non-modulated RF signals via antennas 112 and 113 which axis are shifted about sightline on the same angle in opposite direction in the same way as in the preferred embodiment. This RF signal is reflected by said passive dipole reflectors 110 (or 111) and this reflection is received by the same antenna (112 or 113) that sends this signal, wherein the power of received signal is depend on angular misalignment between axis of transmitting antenna (112 or 113) and rifle-target direction. The transceiver simultaneously transmits and receives signal, wherein sent and received signals are separated by means of RF circulator. If sightline is misaligned with rifle-target direction, the received signal (passed through said RF switch) becomes modulated with switching frequency of said RF switch in the same way as described for the preferred embodiment. Moreover, because said reflected signal is received by the same antenna (112 or 113) that sent this signal, the depth of modulation of the signal passed through said RF switch (position 96 on FIG. 16) is doubled in comparison with the system of preferred embodiment. Thus, this embodiment allows simplifying the system, wherein the response unit attached to possible target is just very light passive reflectors that do not require any power.

Description of Transceiver of this Embodiment Comprising a Dual-Beam RF Rifle-Mounted Transceiver and Attached to Target's Coat RF Reflectors The scheme of the transceiver of this embodiment is depicted in FIG. 16.

The transceiver of this embodiment incorporates transmitting and receiving channel operating in duplex mode. The transceiver is equipped with two antennas 91 and 92 sequentially switched by RF switch 96. The transmitting and receiving channels are separated by means of RF circulator 95.

The transceiver operates as follows:

When power switch 104 is "on", the power supply 103 starts feeding al units of the transceiver so activating said transceiver. Oscillator 93 develops plain RF signal (for example, 10 GHz) that is amplified by power amplifier 94. Output of said power amplifier 94 is connected to TX port of said RF circulator 95, wherein its common port is connected to one of inputs of the RF switch 96, which a first output and a second output are connected to the antenna 112 and antenna 113 correspondently. The RF switch 96 is controlled by generator 97; therefore, said antennas 112 and 113 sequentially transmit said plain RF signal.

This signal is reflected from dipole reflectors attached to wear of the possible target (positions 110 and 111 on FIG. 15) and said reflection reaches the transceiver. Antennas 112 and 113 receive said reflected signal and transmit it common port of RF circulator 95 via RF switch 96, wherein RX port is sequentially connected to low-noise RF amplifier (LNA) 98, detector 99 and filter 100. The output of the filter 100 is connected to input port of a signal switch 101, whose switching is synchronized with switching of RF switch 96. Therefore, DC signal that amplitude is proportional to amplitude of RF signal received by one of the antennas (112 or 113) is directed to one of two inputs of ADT 101 that is dedicated to this antenna. Thus, for example, the demodulated signal coming from antenna 112 is coming to port A of said ADT 101, whereas, the demodulated signal coming from antenna 113 is coming to port B of said ADT 10. Further, these signals are digitized by said ADT 101 and directed to ports A and B of processor 90. The processor 90 calculates ratio of these incoming signals and finally calculates angular shift between the sightline and rifle-target direction. When the target is situated in dangerous sector (for example, ±5 arc degrees about said sightline), the processor 90 activates alert light 105 and buzzer 106.

What is claimed is:

1. A RF system for preventing hunting accidents, which to achieve high resolution of said RF system, comprises:

- a RF transponder attached to a friendly target, which contains a millimeter-wavelength transmitter, which transmits a plain non-modulated RF signal via omnidirectional antenna,
- a RF interrogator mounted on a firearm, which contains a single-input millimeter-wavelength receiver comprising:
  - a first and a second sharp-diagram receiving antennas having similar directional patterns angularly shifted in azimuth on equal angles about a sightline of said firearm in opposite directions, which receive RF signal sent by said RF transponder from the area to which sightline of said firearm is directed,
  - a RF switch sequentially connecting outputs of said first and said second antennas to the input of said single-input millimeter-wavelength receiver, a microprocessor controlling said transmitter and receiver of said interrogator, which develops said request signal and processes said input RF response signal, a microprocessor controlling said transmitter and receiver of said transponder, which processes said input RF request signal and develops said response signal, an alert light mounted on sight of said firearm and activated by said microprocessor of said interrogator, an alert buzzer incorporated in said transponder that is activated by said microprocessor of said transponder, wherein:

RF interrogator sequentially receives said plain non-modulated RF signal by means of sequentially-switched said first receiving antenna and said second receiving antenna, so, if direction to said friendly target is angularly misaligned with said sightline, input signal of said single-input millimeter-wavelength receiver becomes amplitude-modulated with a frequency of switching, wherein depth of said amplitude modulation is proportional to said misalignment that allows determining angular position of said friendly target about said sightline; and, when said friendly target is in dangerous sector of fire, said alert light and said alert buzzer are activated.

2. A RF system for preventing hunting accidents comprising:

a RF interrogator mounted on a firearm, which contains:

a first RF channel comprising a millimeter-wavelength transmitter having an output that transmits a plain non-modulated RF signal, wherein said millimeter-wavelength transmitter is equipped with a first and a second sharp-diagram transmitting antennas having similar directional patterns that are angularly shifted in azimuth on equal angles about a sightline of said firearm in opposite directions, wherein said first and said second transmitting antennas are sequentially connected to said output of said millimeter-wavelength transmitter by means of a RF antenna switch, a second RF channel comprising an receiver that receives an alert RF signal sent by an RF transponder, an alert light mounted on sight of said firearm and activated by said alert RF signal, an alert buzzer incorporated in said interrogator that is activated by said alert RF signal, said RF transponder attached to a friendly target, which contains:

a first RF channel comprising a millimeter-wavelength receiver equipped with an omnidirectional antenna, which receives RF signal sent by said interrogator via said omnidirectional antenna, a second RF channel comprising a RF transmitter that transmits said alert RF signal to said interrogator, an alert buzzer incorporated in said transponder that is activated when said alert RF signal is sent, wherein:

said transponder receives said RF signal sent by said interrogator via omnidirectional RF antenna; so, if direction to said friendly target is angularly misaligned with said sightline, said plain non-modulated RF signal received by said transponder becomes amplitude modulated with a switching frequency of said interrogator's antennas, wherein depth of said amplitude modulation is proportional to said misalignment that allows determining angular position of said friendly target about said sightline; and, when said friendly target is in dangerous sector of fire, said transponder starts alert signal and sends said alert signal RF to said interrogator via said second RF channel.

* * * * *